US006858047B1

(12) United States Patent
Norman

(10) Patent No.: US 6,858,047 B1
(45) Date of Patent: Feb. 22, 2005

(54) FUEL ADDITIVE CONTAINING LITHIUM ALKYLAROMATIC SULFONATE AND PEROXIDES

(76) Inventor: Frank L. Norman, 16 Pagoma La., Lewiston, ME (US) 04240

( * ) Notice: Subject to any disclaimer, the term of this patent is extended or adjusted under 35 U.S.C. 154(b) by 170 days.

(21) Appl. No.: 10/073,448

(22) Filed: Feb. 11, 2002

Related U.S. Application Data

(60) Provisional application No. 60/267,646, filed on Feb. 9, 2001.

(51) Int. Cl.[7] ..... C10L 1/18
(52) U.S. Cl. ..... 44/370; 44/436
(58) Field of Search ..... 44/370, 436

(56) References Cited

U.S. PATENT DOCUMENTS

| | | | | |
|---|---|---|---|---|
| 3,798,012 A | | 3/1974 | Le Suer | |
| 4,200,545 A | | 4/1980 | Clason | |
| 4,659,338 A | | 4/1987 | Johnston | |
| 4,663,063 A | | 5/1987 | Davis | |
| 4,668,247 A | | 5/1987 | Berenyi | |
| 4,724,091 A | | 2/1988 | Davis | |
| 4,740,321 A | | 4/1988 | Davis | |
| 4,781,730 A | | 11/1988 | Stoldt | |
| 4,804,389 A | | 2/1989 | Johnston | |
| 5,023,016 A | * | 6/1991 | Gallacher et al. | 252/389.52 |
| 5,133,900 A | | 7/1992 | Gallacher | |
| 5,169,564 A | | 12/1992 | Gallacher | |
| 5,344,467 A | | 9/1994 | Huang | |
| 5,376,154 A | | 12/1994 | Daly | |
| 6,211,213 B1 | * | 4/2001 | El A'mma | 514/372 |

FOREIGN PATENT DOCUMENTS

| | | | |
|---|---|---|---|
| CN | 87108003 A | * | 5/1988 |
| CN | 1083514 A | * | 3/1994 |
| CN | 1271760 A | * | 11/2000 |

* cited by examiner

*Primary Examiner*—Cephia D. Toomer
(74) *Attorney, Agent, or Firm*—Bradley N. Ruben

(57) ABSTRACT

A fuel additive, especially for gasoline and diesel engines, has a major portion of lithium aromatic sulfonate and an organic peroxide; for example, lithium bezene sulfonate and as the peroxide methyl ethyl ketone peroxide and/or tert-butyl perbenzoate. The additives provides better mileage and better operation for internal combustion engines.

16 Claims, No Drawings

FUEL ADDITIVE CONTAINING LITHIUM ALKYLAROMATIC SULFONATE AND PEROXIDES

This application claims benefit of Provisional No. 60/267,646, filed Feb. 9, 2001.

BACKGROUND OF THE INVENTION

1. Field of the Invention

This invention relates to a novel additive composition for automotive fuels, both gasoline and diesel, and to a method for using the composition.

2. The State of the Art

The fuels which are contemplated for use in the fuel compositions of the present invention are normally liquid hydrocarbon fuels in the gasoline boiling range, including hydrocarbon base fuels. The term "petroleum distillate fuel" also is used to describe the fuels which can be utilized in the fuel compositions of the present invention and which have the above characteristic boiling points. The term, however, is not intended to be restricted to straight-run distillate fractions. The distillate fuel can be straight-run distillate fuel, catalytically or thermally cracked (including hydro cracked) distillate fuel, or a mixture of straight-run distillate fuel, naphthas and the like with cracked distillate stocks. Also, the base fuels used in the formation of the fuel compositions of the present invention can be treated in accordance with well-known commercial methods, such as acid or caustic treatment, hydrogenation, solvent refining, clay treatment, etc.

Gasolines are supplied in a number of different grades depending on the type of service for which they are intended. The gasolines utilized in the present invention include those designed as motor and aviation gasolines. Motor gasolines include those defined by ASTM specification D-439-73 and are composed of a mixture of various types of hydrocarbons including aromatics, olefins, paraffins, isoparaffins, napthenes and occasionally diolefins. Motor gasolines normally have a boiling range within the limits of about 70° F. to 450° F. while aviation gasolines have narrower boiling ranges, usually within the limits of about 100° F. to 330° F.

This invention also contemplates the use of diesel fuels. Diesel engines have been employed as engines for over-the-road vehicles because of relatively low fuel costs and improved mileage. However, because of their operating characteristics, diesel engines discharge a larger amount of carbon black particles or very fine condensate particles or agglomerates thereof as compared to the gasoline engine. These particles or condensates are sometimes referred to as "diesel soot", and the emission of such particles or soot results in pollution and is undesirable. Moreover, diesel soot has been observed to be rich in condensed, polynuclear hydrocarbons, and some of these have been recognized as carcinogenic. Accordingly, particulate traps or filters have been designed for use with diesel engines that are capable of collecting carbon black and condensate particles.

Conventionally, the particulate traps or filters have been composed of a heat-resistant filter element which is formed of porous ceramic or metal fiber and an electric heater for heating and igniting carbon particulates collected by the filter element. The heater is required because the temperatures of the diesel exhaust gas under normal operating conditions are insufficient to burn off the accumulated soot collected in the filter or trap. Generally, temperatures of about 450° C. to 600° C. are required, and the heater provides the necessary increase of the exhaust temperature in order to ignite the particles collected in the trap and to regenerate the trap. Otherwise, there is an accumulation of carbon black, and the trap is eventually plugged causing operational problems due to exhaust back pressure buildup. The above-described heated traps do not provide a complete solution to the problem because the temperature of the exhaust gases is lower than the ignition temperature of carbon particulates while the vehicle runs under normal conditions, and the heat generated by the electric heater is withdrawn by the flowing exhaust gases when the volume of flowing exhaust gases is large. Alternatively, higher temperatures in the trap can be achieved by periodically enriching the air/fuel mixture burned in the diesel engine thereby producing a higher exhaust gas temperature. However, such higher temperatures can cause run-away regeneration leading to high localized temperatures which can damage the trap.

It also has been suggested that the particle build-up in the traps can be controlled by lowering the ignition temperature of the particulates so that the particles begin burning at the lowest possible temperatures. One method of lowering the ignition temperature involves the addition of a combustion improver to the exhaust particulate, and the most practical way to effect the addition of the combustion improver to the exhaust particulate is by adding the combustion improver to the fuel. Copper compounds have been suggested as combustion improvers for fuels including diesel fuels.

The U.S. Environmental Protection Agency (EPA) as of the early 1990s estimated that the average sulfur content of on-highway diesel fuel is approximately 0.25% by weight and had required this level be reduced to no more than 0.05% by weight by Oct. 1, 1993. The EPA also required that this diesel fuel have a minimum cetane index specification of 40 (or meet a maximum aromatics level of 35%). The objective of this rule was to reduce sulfate particulate and carbonaceous and organic particulate emissions. See, Federal Register, Vol. 55, No. 162, Aug. 21, 1990, pp. 34120-34151. Low-sulfur diesel fuels and technology for meeting these emission requirements have not yet been commercially implemented. One approach to meeting these requirements was to provide a low-sulfur diesel fuel additive that could be effectively used in a low-sulfur diesel fuel environment to reduce the ignition temperatures of soot that is collected in the particulate traps of diesel engines.

Various patents, such as U.S. Pat. No. 5,344,467, U.S. Pat. No. 4,340,369, and U.S. Pat. No. 5,376,154, disclosure metal complexes of difunctional organic compounds, including alkali metal salts of difunctional arylsulfonic acids, as fuel additives. Sodium and potassium are the salts of preference. The complex is present in the fuel to provide of up 0.5% by weight of metal (that is, up to 5000 ppm of fuel). The use of alkali earth metal salts of didodecyl benzensulfonic acid for fuel additives is disclosed in U.S. Pat. No. 5,133,900 and U.S. Pat. No. 4,169,564.

U.S. Pat. No. 4,781,730 discloses an alkali metal salt of the reaction product of a polybasic acid and a specified polyhydroxyalkanolamine. Suitable polybasic acids include didodecyl benzenesulfonic acid. Suitable alkali metals are disclosed as including lithium, although the example describes only the use of sodium salts.

U.S. Pat. No. 6,017,369 discloses diesel fuel composition comprising a solution of ethanol, an alkyl ester of a fatty acid, a stabilizing additive selected from the group consisting of (a) a mixture comprising two different ethoxylated fatty alcohols, a cetane booster, and a demulsifier and (b) the reaction product of (1) a mixture of an ethoxylated alcohol and an amide and (2) an ethoxylated fatty acid, and optionally a cosolvent such as naphtha or kerosene. The cetane booster may be t-butyl peroxide. T-butyl peroxide is disclosed in various literature references as a conventional ignition improver or a cetane booster.

U.S. Pat. No. 4,668,247 describes a fuel composition for harnessing the hydrogen energy of a hydrocarbon fuel, comprising 10–90% of a liposoluble organometallic lithium salt and 90–10% of a vehicle oil.

SUMMARY OF THE INVENTION

In light of the foregoing, an object of this invention is to provide a fuel additive for use with gasoline or diesel fuels that provides at least one of the following benefits: an increase in fuel mileage; a smoother running engine; more power; reduced fouling of the fuel system; cleaning the fuel system, including injectors; and diminishing "diesel rap" in diesel engines.

Another object of this invention is to improve home heating systems that use oil by providing at least one of the following benefits: better fuel atomization; hotter flame temperatures; more complete combustion; and less soot generation.

Yet another object of this invention is to improve coal-fired systems by providing at least one of the following benefits: better fuel atomization for coal-oil slurries; hotter flame temperatures; more complete combustion; and less soot generation.

In summary, the foregoing objectives are achieved through the use of a fuel additive comprising a mixture of lithium didodecylbenzenesulfonate, t-butyl perbenzoate, and MEK peroxide. The additive is preferably provided in a solvent such as diphenyl (also known as 1,1'-biphenyl, bibenzene, phenylbenzene, and lemonene), which has a pleasant (though apparently peculiar) odor, to provide a more aesthetically pleasing product for a consumer. Otherwise, the additive can be formulated into the fuel composition itself without the use of a solvent. It is preferably provided in an amount of 0.0001 to 5 percent by weight to an existing fuel.

DESCRIPTION OF SPECIFIC EMBODIMENTS

This invention is directed to a fuel additive, a fuel containing the additive, and a method for using each. The invention in its broadest sense is as an additive composition comprising 5–95% of lithium dodecylbenzenesulfonic acid and an organic peroxide such as 3–30% of tertiary-butyl peroxide and/or 2–20% of MEKP. The additive composition can be added directly to a fuel or it can be stored in a solvent which is added to the fuel when desired. When added directly to a fuel, the fuel should comprise about 0.001 wt. % to 5 wt. % of the additive composition. When the additive is stored in a solvent, the solvent is preferably something that will work well in an internal combustion engine, such as diphenyl. The additive is preferably added in a volume amount of additive to solvent of from about 5:1 to 1:20, and most preferably about 1:1. Thereafter, the additive (optionally in a solvent) is added to a fuel in a volume amount of additive to fuel of from about 1:100 to about 1:10,000; an exemplary amount is about one ounce additive to ten gallons of fuel.

The specific compounds used herein are commercially known and available, although not necessarily for their use in this invention. The lithium didodecylbenzene sulfonate is described in various patents mentioned above in the Background section, which disclosures are incorporated herein by reference. While other alkali metal and/or alkali earth metal salts may be included in the present composition, it is preferred that the primary metal be lithium. Additionally, while didodecylbenzene sulfonate is preferred, any alkyl- or dialkylaromatic sulfonate, such as those described in the aforementioned patents, can be used in the present invention; preferred alkyl groups are straight or slightly branched chains having from about seven to about 35 carbon atoms; and aromatic means a cyclic conjugated hydrocarbon such as benzene or naphthalene, or a derivative thereof.

As described in the Background section, t-butyl perbenzoate is a known fuel additive, described as a conventional ignition improver or a cetane booster.

Methyl ethyl ketone peroxide (also known as 2-butanone peroxide, ethyl methyl ketone peroxide, or MEKP), is used generally as a polymerization catalyst in the manufacture of polyester and acrylic resins and as a hardening agent for fiberglass reinforced plastics. It is a colourless liquid with a characteristic odour. It is considered a combustible liquid and vapour. It is also very toxic. Accordingly, it should be handled with extreme care.

As noted, the additive can be added directly to a fuel, or it can be stored in a solvent and added to a fuel as desired (for example, the solvated and stored additive can be packaged and shipped as conventional fuel additives, and then added to a tank of gas when the user fills up at a service station). As such, when formulated into a solvent-based system, the additive can be stored in a benzyl-containing solvent such as d-lemonene (diphenyl), or the like. Any organic solvent that is miscible and otherwise compatible with fuel, especially gasoline and diesel, is suitable as the solvent.

The present additive is generally useful for all gasoline-powered, artificial ignition, internal combustion engines, such as used in automobiles and trucks, motorcycles, lawn mowers, snow blowers, leaf blowers, weeders, chain saws, and the like. The additive is also useful for diesel-powered internal combustion engines, such as are used in automobiles and trucks. The additive is also useful for fired heating systems, such as those that use home heating oil (e.g., No. 2 or No. 4 oil), kerosene, and the like.

EXAMPLE 1

An 18-wheeler powered by a Cumins diesel engine typically achieves a mileage of about 7.0 miles per gallon of diesel fuel with a load of about 40,000 pounds. On a typical trip from New Jersey to Missouri (St. Louis) the mileage is about 950 miles, and the round trip is about 1900 miles. Using about 28 oz. of the inventive composition per tank of fuel, the mileage with the same weight over the same trip increased about 7.5% to about 7.5 miles per gallon.

EXAMPLE 2

A 1999 Ford Escort LX automobile with about 23,400 miles was tested at an EPA-certified laboratory using the "Hot 505" procedure. The fuel tank was drained and a standardized indolene fuel (96 octane) with and without the novel additive was used. The results obtained (by independent testing at Compliance and Research Services, Inc., Linden, N.J.) were as follows:

| Variable | Fuel alone | Fuel with additive | Percent Change |
|---|---|---|---|
| Hydrocarbons | 0.0 | 0.0 | 0.0 |
| Carbon Monoxide | 0.147 | 0.139 | −5.4 |
| Nitrogen Oxides | 0.201 | 0.137 | −31.8 |
| Carbon Dioxide | 283.816 | 277.385 | −2.26 |
| Miles/gallon | 31.22 | 31.95 | +2.31 |

The amounts given in the table for the variables (other than mileage) are in grams/miles. The catalyst system was new and so the hydrocarbon readings were zero. Nevertheless, the $NO_X$ emissions were decreased by 31% and mileage increased by 2.31%. Also, the combined carbon output (CO and $CO_2$) decreased by almost eight percent. These results were achieved with only about two ounces of additive (in solvent at about 1:1 dilution) to ten gallons of fuel. Conventional oxygenated fuel (RFG2) would contain about 1.1 gallons of MTBE (methyl tert-butyl ether) to ten gallons of fuel, and mileage is actually reduced with the MTBE additive.

EXAMPLE 3

A blend was made of the following components of the additive:

280 g. lithium didodecylbenzenesulfonate 25 g. methyl ethyl ketone peroxide (MEKP)

50 g. tert-butyl perbenzoate (TBPB)

The 355 grams of this blend was then blended with 445 grams of solvent, d-limonene; the weight ratio of additive to solvent (which is close to the volume ratio) was thus about 4:5.

The instant composition has been used in various vehicles, from motorcycles, to early model and late model automobiles (e.g., 1972 Cadillac, 1994 Chevrolet), to industrial equipment (e.g., Case 580 backhoe), to trucks (e.g., 1994 Mack), running gasoline or diesel. All experience better mileage and improved performance.

The forgoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A fuel composition consisting essentially of a petroleum-based liquid hydrocarbon fuel in admixture with a fuel additive comprising 5–95% of a lithium aromatic sulfonate and an organic peroxide.

2. The fuel composition of claim 1, wherein the additive is provided in a solvent-based system.

3. The fuel composition of claim 1, wherein the additive includes two organic peroxides.

4. The fuel composition of claim 3, wherein one peroxide is tert-butyl perbenzoate.

5. The fuel composition of claim 3, wherein one peroxide is 2-butanone peroxide.

6. The fuel composition of claim 1, wherein the lithium aromatic sulfonate is a $C_{7-35}$ alkylbenzenesulfonate.

7. The fuel composition of claim 1, wherein the lithium aromatic sulfonate is didodecylbenzene sulfonate.

8. The fuel composition of claim 2, wherein the solvent is diphenyl.

9. The fuel composition of claim 1, wherein the liquid hydrocarbon fuel is gasoline.

10. The fuel composition of claim 1, wherein the liquid hydrocarbon fuel is diesel.

11. A method for improving the operation of a gasoline-powered, artificial ignition, internal combustion engine, comprising providing to said engine a fuel composition consisting essentially of gasoline and a fuel additive comprising a mixture of 5–95% of lithium aromatic sulfonate and an organic peroxide.

12. The method of claim 11, wherein the fuel additive is provided in a solvent-based system miscible with said gasoline fuel.

13. The method of claim 11, wherein the fuel comprises from 1 to 100 parts by weight of additive to 10,000 parts by weight of fuel.

14. The fuel composition of claim 1, wherein the liquid hydrocarbon fuel is heating oil.

15. The fuel composition of claim 1, wherein the organic peroxide is tert-butyl peroxide.

16. The fuel composition of claim 1, wherein the organic peroxide is methyl ethyl ketone peroxide.

* * * * *